US005879068A

United States Patent [19]

Menashrov et al.

[11] Patent Number: 5,879,068

[45] Date of Patent: Mar. 9, 1999

[54] ILLUMINATED DRINKING VESSEL

[76] Inventors: Gavriel Menashrov; Coral Menashrov, both of 7411 Delco Ave., Canoga Park, Calif. 91306-2840

[21] Appl. No.: 60,838

[22] Filed: Apr. 15, 1998

Related U.S. Application Data

[60] Provisional application No. 60/048,446 Jun. 3, 1997.

[51] Int. Cl.[6] ..... F21V 33/00

[52] U.S. Cl. ..... 362/101; 362/276; 362/806

[58] Field of Search ..... 362/101, 276, 362/802, 806, 340, 800

[56] References Cited

U.S. PATENT DOCUMENTS

| | | | |
|---|---|---|---|
| 919,691 | 4/1909 | Cahill . | |
| 2,177,337 | 10/1939 | Stein . | |
| 2,224,319 | 12/1940 | Schroer . | |
| 2,532,181 | 11/1950 | Moore . | |
| 2,663,866 | 12/1953 | Simpson . | |
| 3,218,447 | 11/1965 | Pardue . | |
| 3,374,344 | 3/1968 | Rudolph et al. . | |
| 3,735,113 | 5/1973 | Stott . | |
| 3,878,386 | 4/1975 | Douglas | 362/101 |
| 4,922,355 | 5/1990 | Dietz et al. | 362/101 |
| 5,070,435 | 12/1991 | Weller | 362/101 |
| 5,119,279 | 6/1992 | Makowsky | 362/101 |
| 5,211,699 | 5/1993 | Tipton | 362/101 |
| 5,339,548 | 8/1994 | Russell | 362/101 X |

*Primary Examiner*—Stephen Husar
*Attorney, Agent, or Firm*—Kelly Bauersfeld Lowry & Kelley, LLP

[57] ABSTRACT

An illuminated drinking vessel includes an upper fluid-retaining cup and a lower hollow supporting stem. A light emitting diode is mounted within the hollow stem adjacent to the upper cup, and a pair of switch mechanisms are provided for selectively connecting the light emitting diode with a battery mounted within the hollow stem. More particularly, a first switch mechanism is provided that is actuated by grasping the supporting stem when lifting the drinking vessel. A second switch mechanism is actuated upon filling of the upper cup with a fluid when the supporting stem is resting on a generally horizontal surface.

16 Claims, 2 Drawing Sheets

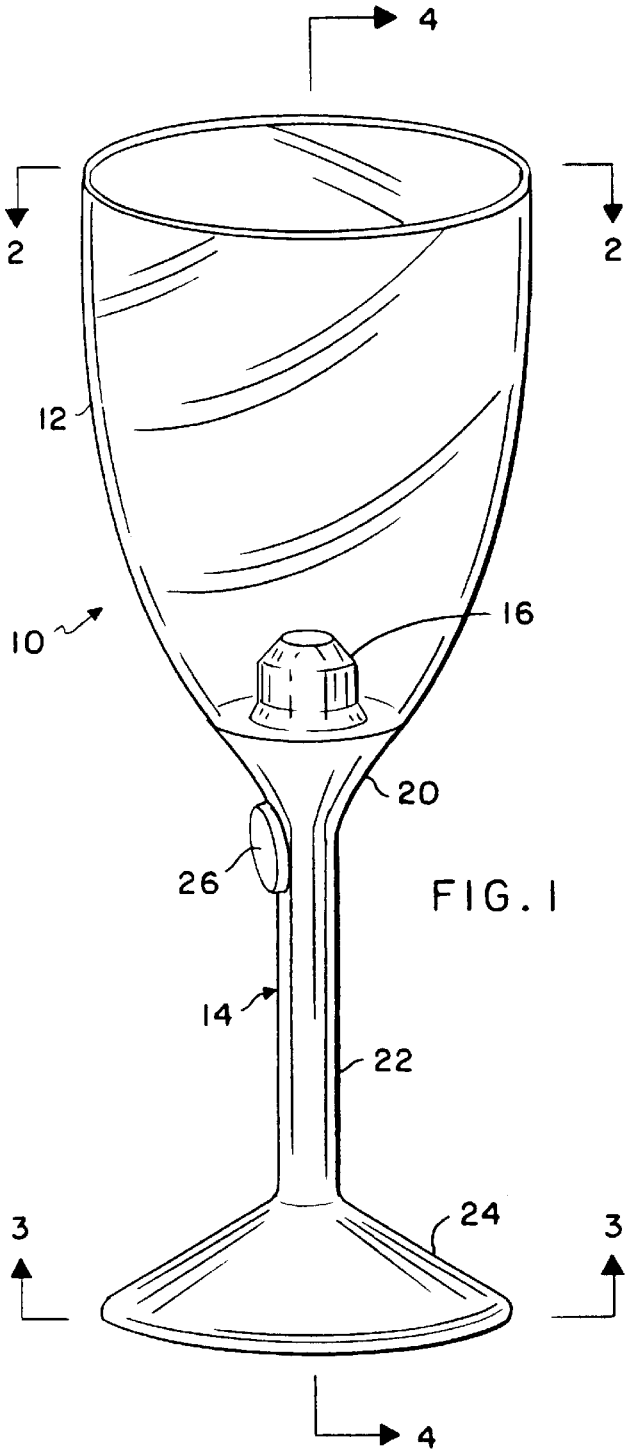
FIG. 1
FIG. 2
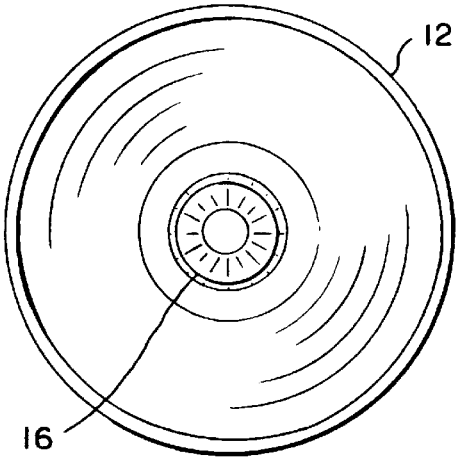
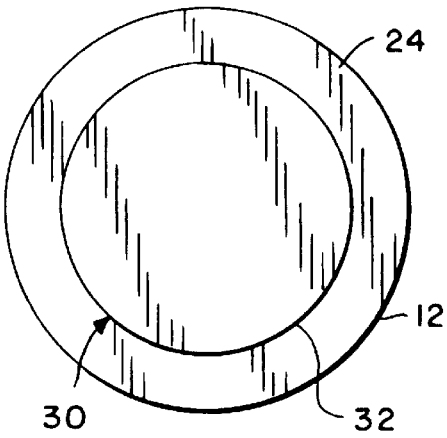
FIG. 3

ILLUMINATED DRINKING VESSEL

BACKGROUND OF THE INVENTION

This application claims benefits of Provisional Appln. 60/048,446 filed Jun. 3, 1997.

This invention relates generally to drinking vessels. More specifically, the present invention relates to an illuminated drinking vessel in which the liquid content of the vessel is illuminated under defined conditions.

Drinking vessels such as cups, mugs and wine glasses are in quite common usage. Many times such drinking vessels are utilized in dimly-lit environments. In such conditions, it would be helpful to utilize the drinking vessel itself to provide some form of illumination, not only from a utilitarian point of view but also from an entertaining and/or aesthetic point of view. The combination of one or more lights with a drinking vessel can be attractive to the user and can provide a form of amusement.

There have been a number of lighted drinking vessels devised, which all incorporate some type of light associated with a drinking cup, a power source and a switch. For example, in U.S. Pat. No. 919,691, a subbase separable from the drinking vessel is provided for housing a battery. When the drinking vessel is placed on the subbase, an incandescent electric lamp is caused to be illuminated. In another illuminated drinking vessel the illumination is accomplished automatically by the raising of the receptacle through a switch in the base, as shown in U.S. Pat. No. 2,177,337. In a like manner, the illuminated drinking vessel of U.S. Pat. No. 2,224,319 illustrates a switch mechanism in the base of the drinking vessel which causes a lamp to be illuminated whenever the drinking vessel is held in one's hand, but extinguishes the light when the drinking vessel is placed on a tray or table. Other variations are illustrated in U.S. Pat. Nos. 2,532,818; 2,663,866; 3,218,447; 3,374,344; 3,735,113; 3,878,386; 4,922,355; 5,070,435; 5,119,279; and 5,211,699.

A review of the foregoing prior art devices shows that there has not been yet devised an illuminated drinking vessel wherein the lamp is turned off unless either one of two conditions is satisfied, namely (1) filling the cup with a fluid, or manually actuating a switch upon lifting of the drinking vessel. It is believed that such a drinking vessel is needed which permits the lamp to be actuated both directly and indirectly by the user. Directly in the sense that the lamp would be illuminated when the user lifts the drinking vessel, and indirectly in the sense that the lamp would be illuminated when the fluid-retaining cup is filled. The present invention fulfills these needs and provides other related advantages.

SUMMARY OF THE INVENTION

The present invention resides in an illuminated drinking vessel having a lamp disposed therein for illuminating the fluid contents within a fluid-retaining cup. The lamp would normally be switched off unless one or both of two predefined conditions exist: namely illumination of the bulb by direct contact with a switch actuated upon grasping the drinking vessel, or simply filling the cup with a fluid while the drinking vessel is supported over a generally horizontal surface. In this regard, the illuminated drinking vessel comprises an upper fluid-retaining cup and a lower hollow supporting stem. Light emitting means are mounted within the hollow stem adjacent to the upper cup. First means are provided for energizing the light emitting means upon grasping the supporting stem when lifting the drinking vessel. Second means are provided for energizing the light emitting means upon filling of the upper cup with a fluid when the supporting stem is resting on the generally horizontal surface.

In a preferred form of the invention, the upper fluid-retaining cup includes a prismatic bubble in a lower end thereof. The light emitting means comprises a light emitting diode which extends upwardly from the hollow stem and is disposed within the prismatic bubble. A battery is mounted within the hollow stem to provide power for the light emitting diode.

A first switch mechanism is provided for a first circuit between the light emitting diode and the battery. The first switch mechanism comprises a lifting switch which is exteriorly mounted on the stem adjacent to a lower end of the fluid-retaining cup. The first switch mechanism is actuated by grasping the supporting stem when lifting the drinking vessel.

A second switch mechanism is provided for a second circuit between the light emitting diode and the battery. The second switch mechanism is mounted adjacent to a lower end of the supporting stem and includes a movable base plate that supports the stem when placed on the generally horizontal surface, and a micro-switch which is responsive to the vertical positioning of the base plate. Spring means are provided for biasing the base plate downwardly relatively to the lower end of the supporting stem. The second switch mechanism is actuated upon filling of the upper cup with a fluid when the supporting stem is resting on the generally horizontal surface.

Other features and advantages of the present invention will become apparent from the following more detained description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a top and side perspective view of an illuminated drinking vessel embodying the present invention;

FIG. 2 is a top plan view thereof taken generally along the line 2—2 of FIG. 1;

FIG. 3 is a bottom plan view thereof taken generally along the line 3—3 of FIG. 1.

DETAILED DESCRIPTION OF THE PREFERRED EMBODIMENT

Figure 4:
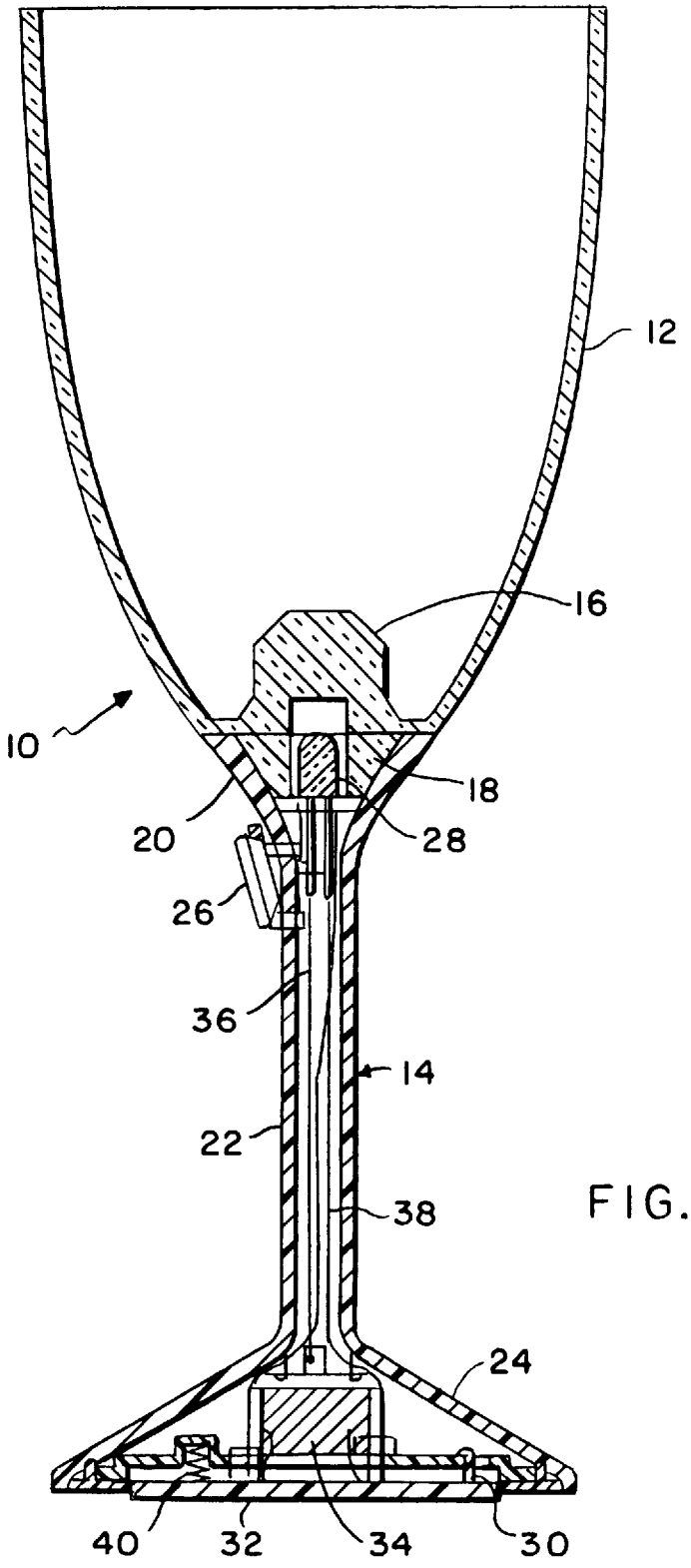
FIG. 4 is a sectional view taken generally along the line 4—4 of FIG. 1.

As shown in the drawings for purposes of illustration, the present invention is concerned with an illuminated drinking vessel, generally designated by the reference number 10. As illustrated in FIGS. 1–3, the illuminated drinking vessel 10 comprises an upper fluid retaining cup 12, and a lower hollow supporting stem 14. Typically the cup 12 is manufactured of a transparent or translucent material, and includes a prismatic bubble 16 in a lower end 18 thereof. The lower end 18 of the upper fluid-retaining cup 12 is configured for insertion into an upper end 20 of the supporting stem 14 (see FIG. 4).

The lower hollow supporting stem 14 may be of any desired configuration, and as shown includes an intermediate tubular stem 22 that extends downwardly from the upper end 20 to a frusto-conical base 24 which supports the drinking vessel 10 over a generally horizontal surface.

A first switch mechanism comprises a lifting switch which is exteriorly mounted on the stem 14 adjacent to the lower end 18 of the fluid-retaining cup 12. This first switch mechanism 26 may be positively engaged by one grasping the drinking vessel 10 as it is being lifted to energize a lamp, such as the light emitting diode 28 (FIG. 4) to illuminate the drinking vessel 10. A second switch mechanism 30 is mounted adjacent to the frusto-conical base 24 of the supporting stem 14, and includes a movable base plate 32 that is configured and positioned relative to the base 24 to support the stem 14 when the drinking vessel 10 is placed on a generally horizontal surface.

More particularly, and with reference to FIG. 4, the light emitting diode 28 extends upwardly from the upper end 20 of the hollow stem 14 and is disposed within a recess formed in the lower end 18 of the cup and the prismatic bubble 16. A battery 34 is mounted within the hollow stem 14, and centrally within the frusto-conical base 24 above the base plate 32. A first circuit extends between the light emitting diode 28 and the battery 34 through the first switch mechanism 26. This permits the first switch mechanism, upon being actuated by grasping the supporting stem 14 when lifting the drinking vessel 10, to close the first circuit 36 to illuminate the light emitting diode 28.

A second circuit 38 extends between the light emitting diode 28 and the battery 34 through the second switch mechanism 30. This arrangement permits the second switch mechanism to be actuated upon filling of the upper cup 12 with a fluid when the supporting stem 14, and specifically the base plate 32, is resting on the generally horizontal surface to illuminate the light emitting diode 28. In this regard, the second switch mechanism 30 includes a micro switch that is responsive to the vertical positioning of the base plate 32. Several compression springs 40 are disposed between the base 24 and the base plate 32 to bias the base plate downwardly relative to the lower end of the supporting stem 14. The spring coefficient must be sufficiently great to prevent closing of the second circuit 38 when an empty drinking vessel 10 is placed on the generally horizontal surface. Only upon filling of the upper fluid-retaining cup 12 with a fluid should cause the base plate 32 to move relative to the base 24 to cause the second switch mechanism 30 to close the second circuit 38 and thus illuminate the light emitting diode 28.

From the foregoing it will be appreciated that a novel illuminated drinking vessel 10 has been provided which has two circuits 36 and 38 extending between a battery 34 and the light emitting diode 28. A pair of switch mechanisms 26 and 30 are provided which, normally, are open to interrupt power supply from the battery to the light emitting diode 28. When either or both of two predefined conditions exist, however, one or both of the circuits 36 and 38 are closed. Power is thus supplied to the light emitting diode to illuminate it and, through the prismatic bubble 16, the transparent or translucent cup portion of the drinking vessel 10.

Although a particular embodiment of the invention has been described in detail for purposes of illustration, various modifications may be made without departing from the spirit and scope of the invention. Accordingly, the invention is not to be limited, except as by the appended claims.

We claim:

1. An illuminated drinking vessel, comprising:

an upper fluid-retaining cup, and a lower hollow supporting stem;

light emitting means mounted within the hollow stem adjacent to the upper cup;

a battery mounted within the hollow stem;

a first switch mechanism for a first circuit between the light emitting means and the battery, the first switch mechanism being actuated by grasping the supporting stem when lifting the drinking vessel; and a second switch mechanism for a second circuit between the light emitting means and the battery, the second switch mechanism being actuated upon filling of the upper cup with a fluid when the supporting stem is resting on a generally horizontal surface.

2. The illuminated drinking vessel of claim 1, wherein the fluid-retaining cup includes a prismatic bubble in a lower end thereof, and wherein the light emitting means is disposed within the prismatic bubble.

3. The illuminated drinking vessel of claim 2, wherein the light emitting means is a light emitting diode.

4. The illuminated drinking vessel of claim 1, wherein the first switch mechanism comprises a lifting switch exteriorly mounted on the stem adjacent to a lower end of the fluid-retaining cup.

5. The illuminated drinking vessel of claim 1, wherein the second switch mechanism is mounted adjacent to a lower end of the supporting stem, and includes a movable base plate that supports the stem when placed on the generally horizontal surface, and a micro-switch responsive to the vertical position of the base plate.

6. The illuminated drinking vessel of claim 5, including spring means for biasing the base plate downwardly relative to the lower end of the supporting stem.

7. An illuminated drinking vessel, comprising:

an upper fluid-retaining cup, and a lower hollow supporting stem;

light emitting means mounted within the hollow stem adjacent to the upper cup;

first means for energizing the light emitting means upon grasping the supporting stem when lifting the drinking vessel; and second means for energizing the light emitting means upon filling of the upper cup with a fluid when the supporting stem is resting on a generally horizontal surface.

8. The illuminated drinking vessel of claim 7, wherein the first energizing means comprises a first switch mechanism for a first circuit between the light emitting means and a battery.

9. The illuminated drinking vessel of claim 8, wherein the first switch mechanism comprises a lifting switch exteriorly mounted on the stem adjacent to a lower end of the fluid-retaining cup.

10. The illuminated drinking vessel of claim 7, wherein the second engaging means comprises a second switch for a second circuit between the light emitting means and a battery.

11. The illuminated drinking vessel of claim 10, wherein the second switch mechanism is mounted adjacent to a lower end of the supporting stem, and includes a movable base plate that supports the stem when placed on the generally horizontal surface, and a micro-switch responsive to the vertical position of the base plate.

12. The illuminated drinking vessel of claim 11, including spring means for biasing the base plate downwardly relative to the lower end of the supporting stem.

13. The illuminated drinking vessel of claim 7, wherein the light emitting means is a light emitting diode.

14. The illuminated drinking vessel of claim 13, wherein the fluid-retaining cup includes a prismatic bubble in a lower end thereof, and wherein the light emitting diode is disposed within the prismatic bubble.

15. An illuminated drinking vessel, comprising:

an upper fluid-retaining cup and a lower hollow supporting stem, the fluid-retaining cup including a prismatic bubble in a lower end thereof;

a light emitting diode extending upwardly from the hollow stem and disposed within the prismatic bubble;

a battery mounted within the hollow stem;

a first switch mechanism for a first circuit between the light emitting diode and the battery, comprising a lifting switch exteriorly mounted on the stem adjacent to a lower end of the fluid-retaining cup, the first switch mechanism being actuated by grasping the supporting stem when lifting the drinking vessel; and a second switch mechanism for a second circuit between the light emitting diode and the battery, the second switch mechanism being mounted adjacent to a lower end of the supporting stem and including a movable base plate that supports the stem when placed on a generally horizontal surface, and a micro-switch responsive to the vertical positioning of the base plate, wherein the second switch mechanism is actuated upon filling of the upper cup with a fluid when the supporting stem is resting on the generally horizontal surface.

16. The illuminated drinking vessel of claim 15, including spring means for biasing the base plate downwardly relative to the lower end of the supporting stem.

* * * * *